United States Patent [19]

Anderson

[11] Patent Number: 4,719,685

[45] Date of Patent: Jan. 19, 1988

[54] JACK DEVICE FOR WASHING MACHINES

[76] Inventor: Jeff H. Anderson, 527 N. Azusa Ave., Suite 188, Covina, Calif. 91722

[21] Appl. No.: 892,365

[22] Filed: Aug. 4, 1986

[51] Int. Cl.[4] ..... B25B 27/14

[52] U.S. Cl. ..... 29/252; 254/93 HP

[58] Field of Search ..... 254/93 HP; 29/252; 441/90, 91, 92, 108, 113

[56] References Cited

U.S. PATENT DOCUMENTS

| | | | |
|---|---|---|---|
| 665,924 | 1/1901 | McGee | 441/91 |
| 1,212,315 | 1/1917 | Bjerre | 441/113 |
| 3,967,360 | 7/1976 | Nolte | 254/93 HP |

FOREIGN PATENT DOCUMENTS

| | | | |
|---|---|---|---|
| 1217571 | 5/1966 | Fed. Rep. of Germany | 254/93 HP |
| 1456399 | 11/1976 | United Kingdom | 254/93 HP |
| 625079 | 9/1978 | U.S.S.R. | 254/93 HP |

*Primary Examiner*—Robert C. Watson
*Attorney, Agent, or Firm*—William M. Harris

[57] ABSTRACT

A jack device employed to extract agitators from the drive shafts of washing machines. The device includes an annular split ring member having two closed ends and enclosed chamber therein. The enclosed bladder device expands into a split toroidal configuration. A tube attached at the periphery and extending from under the agitator to the outside tub is employed to transfer hydraulic or pneumatic pressure into the said device resulting in expansion of the same. The wall of the bladder is thicker in a zone around the periphery than elsewhere. This thicker zone prevents the device from ballooning out from under the agitator which would result in failure of successfully removing the agitator from the shaft.

2 Claims, 5 Drawing Figures

JACK DEVICE FOR WASHING MACHINES

BACKGROUND

1. Field of Invention

This invention relates to the field of washing machines, specifically to an improved device used for removing agitators off the shafts of washing machine drive splines.

2. Discussion of Prior Art

Under most conditions, in order to repair washing machines, it is necessary to remove the agitator off the drive shaft. After a period of normal use the agitator becomes cemented to the shaft from minerals and soap in the water. Removing these stuck agitators from their drive shafts is a problem that every washing machine repairman faces wherever automatic washing machines are used.

Heretofore several different methods have been employed to remove the agitators off drive shafts.

Some mechanical devices are available for specific models of washing machines. These devices operate by extending flat bar arms down and hooking to the peripheral lip on the agitator. A threaded screw device on top is then screwed down on the center of the shaft through a hole drilled in the agitator forcing pressure on the lower lip of the agitator. The general result is tearing or ripping of the agitator which must then be discarded and replaced. The hole which was drilled for the screw device must be sealed with silicone glue if the agitator should be removed in one piece and found to be reuseable.

Users regarded these devices unsatisfactory for removing agitators as they are cumbersome, expensive, destructive, and time consuming. Also the users must buy several different ones for the different types of machines.

A crude method which works, but again is unsatisfactory, is using a belt and two by four length of wood and having two or three indiviuals jerk the agitator out. Basically the belt is wrapped around the base of the agitator and then brought up and out of the washing machine and tried to the wood. At this point one individual may stablize the washer while two others jerk on the two by four. Again much material damage and possible personal injury results from such method even though the result is removal of the agitator.

The most effective and quickest way commonly used is to employ a hammer and chisel and break up the agitator. This method works but again is always destructive and requires replacement of the agitator.

U.S. Pat. No. 3,967,360 by Nolte describes a pneumatic jack device employing an annular split ring member having closed ends which are joined together with an eyelet and hook. This pneumatic jack lifter is placed under the agitator and filled with pressurized gas to lift the agitator out. This idea expresses the method needed to be used to remove agitators, however, it does possess at least three undesirable features.

First the bladder device when inflated will follow the path of least resistance. When attempting to remove agitators with this device, the bladder, following the path of least resistance, will balloon out from under the agitator to the periphery of the agitator. Due to this ballooning out action the device will fail in getting the agitator off the drive shaft.

Another problem in using said device is attaching the hook to the eyelet. The space available between the base of the wash tub and the underside of the agitator ranges from three eights to less than half of an inch. The inventor showed that it was necessary to keep the ends of the device from separating immediately as soon as pressure was applied to the device. Attaching the hook to the eyelet at the ends of the device in the limited amount of working space is not easily accomplished.

Another serious drawback of this design is the use of a pneumatic pressurized source. On some stuck agitators an ever increasing amount of pressure must be applied to release the agitator. Once the agitator breaks free the built up pressure expands the device rapidly which can rocket the agitator up at a tremendous speed. Tests have proven the built up pressure can propel the agitator out of the machine and bounce off fifteen foot ceilings. If a person should be peering into the opening of the washing machine injury can result if the agitator should impact them.

Three other pneumatic lifters that have been patented, but can not be used to remove agitators as they are not capable of fitting under the shoulder of a washing machine, are U.S. Pat. No. 3,026,521, U.S. Pat. No. 3,346,885, and U.S. Pat. No. 3,822,861. The first device is a pneumatic lifter for a bed patient which is of an elongated rectangular shape. The second device employs an air lift mattress for use in a bath tub wherein the mattress is of rectangular shape. The third employs an inflatable form breaker for molded construction, wherein a rectangular shaped member is inflated into an ellipsoidal configuration.

SUMMARY OF THE INVENTION

My present invention introduces a unique and vast improvement in operation and increased efficiency. It will thereby overcome all of the above noted disadvantages of the Nolte pneumatic device.

Briefly, my novel improved agitator removal means comprises an inflatable bladder of such size and shape as to fit easily, in deflated form, into the area under the agitator of the washer. Since my invention utilizes a unique design the body of said device is prevented from ballooning out as on the Nolte device, hence the hook and eyelet are not required. Because the hook and eyelet are eliminated, placing and positioning the device under the agitator is a much simpler task than using the Nolte device.

Once in position the fill tube of the supply line is attached to an available water supply. By applying hydraulic pressure to the said device, it will expand inward towards the center drive shaft to lift the agitator gently off the shaft. The bladder is designed to inflate in such a manner as to apply its pressure on the underside of the agitator and not balloon ineffectually out of the space between the agitator and tub bottom.

Using hydraulic pressure in place of pneumatic pressure as in the Nolte device allows for a safer operation. This is because using hydraulic pressure the body of the device does not expand rapidly as soon as the agitator breaks free from its shaft. This prevents the agitator from rocketing out of the washing machine. Since all automatic washing machines have a ready supply of water connected to them, my invention has been designed to use this available hydraulic water pressure. This allows the repairman to repair the washing machines easily in the field. With the Nolte device it is necessary for the repairman to have a source of pneumatic pressure.

My invention is also superior over the mechanical agitator removal means for several reasons. First, it does not damage the agitators. It will work on a variety of washing machines. It is much faster and less dangerous.

It is thus a principal object of this invention to provide a positive means for quickly and safely freeing spline mounted agitators in automatic washing machines from their shafts.

Further objects and advantages of may invention will become apparent from a consideration of the drawings and ensuing description of it.

LIST OF REFERENCE NUMERALS

Figure 1:
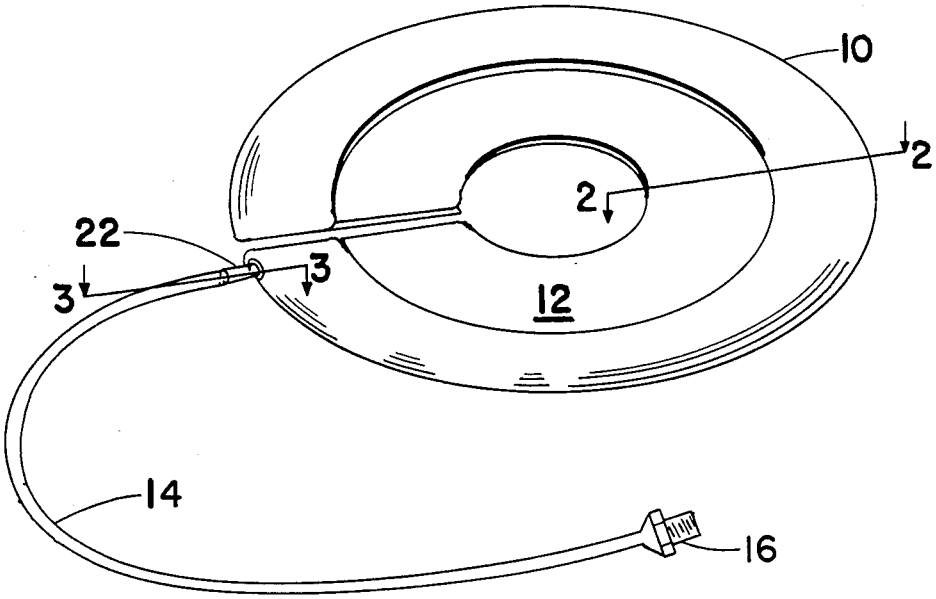
FIG. 1 is an isometric view of the deflated washing machine removal means of preferred form in accordance with this invention.

10 embodiment bladder means
12 inflatable bladder
14 fill tube to bladder
16 male hose entry fitting
17 doubler attachment
18 180° bend
20 heavier area of one piece body
22 entry tube to bladder
24 tube coupler

DESCRIPTION OF THE PREFERRED EMBODIMENT

Considering now the drawing in greater detail, there is shown generally at 10 in FIG. 1 a preferred embodiment of my washing machine agitator removing means. The washing machine agitator removing means 10 comprises an inflatable bladder 12 in the shape of a flattened, interrupted or split torus when deflated, and an attached tube 14 of flexible character, with male hose fitting 16 on the extended end, through which the bladder can be inflated with available water. Bladder 12 can be made of rubber, latex or any other suitable material having rubber-like properties, and the flexible tube 14 is preferably, but not necessarily made of polyethylene.

Figure 2:
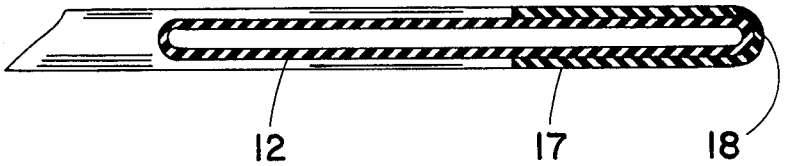
FIG. 2 is an enlarged cross-sectional view of a fragmentary portion thereof taken along line 2—2 of FIG. 1.
Figure 3:
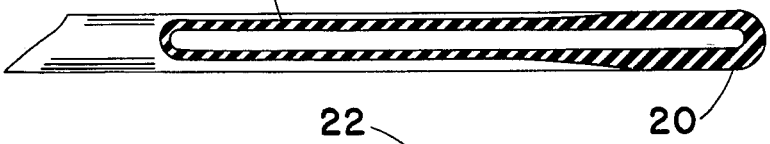
FIG. 3 is an enlarged cross-sectional view of a fragmentary portion thereof taken along line 2—2 of FIG. 1. This sectional view is depicting the configuration when the device is fabricated in a mold with the periphery heavier as shown.

The bladder 12 has a wall that is a thicker concentrically outwardly disposed zone, shown at 17 in FIG. 2 and also at 20 in FIG. 3, for all practical purposes twice as thick at the periphery. FIGS. 2 and 3 each show a radial cross section through the bladder 12 illustrating this difference in wall thickness between its concentric inner and outer portions. At its periphery in FIG. 2 the wall of bladder 12 forms a 180° bend 18 having an outside radius of preferably ¼ inch. The area 17 portions increased wall thickness is the result of a close fit "doubler" tightly secured in a U-shaped configuration. This doubler embraces approximately the outer one third portion of the separate core bladder, best illustrated at 12 and 17 in FIG. 2. I have shown how the bladder 12 might possibly be produced in one piece. In FIG. 3 the bladder 12 is the same thickness as indicated in FIGS. 2–12 and at the periphery 20 it has increased in size to equal that in FIG. 2 at location 17.

Figure 4:
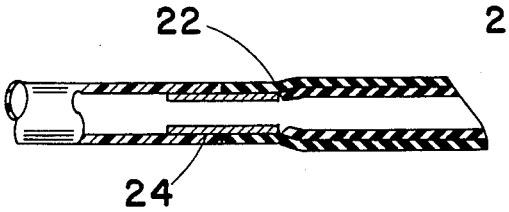
FIG. 4 is an enlarged cross-sectional view of a fragmentary portion thereof taken along line 3—3 in FIG. 1.

Flexible fill tube 14 is attached to the bladder at location 22 in FIG. 1 with one of many methods. One preferred method is to employ a ¾ inch length of tubing being ⅜ inch O.D. and ⅛ inch I.D. This tube can be of metal, polyethylene, nylon or any suitable composition. Tube 24 in FIG. 4 is employed as a coupler to join fill tube 14 and entry tube 22. Said fill tube 14 and entry tube 22 are secured by the use of glue and use of close profile clamps.

Figure 5:
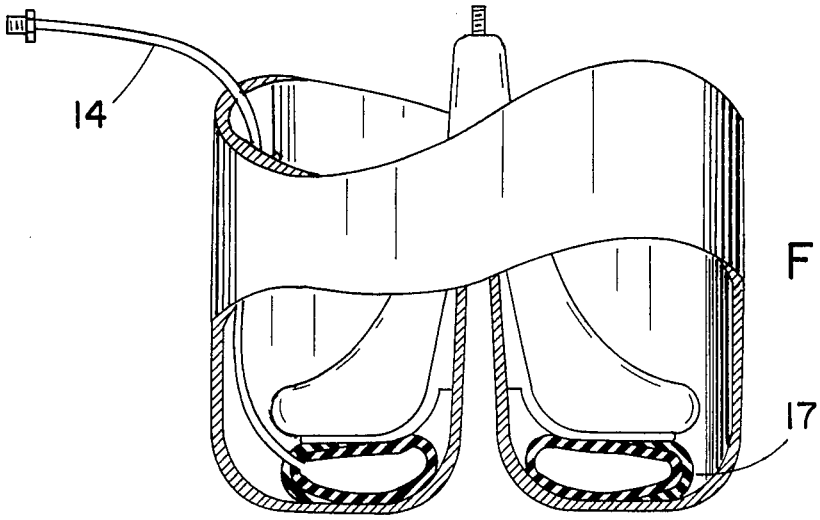
FIG. 5 is a fragmentary view, partly broken away and partly in section, of an automatic washer tub and spline-mounted agitator with a bladder forming the main part of the washing machine agitator removal means positioned under the agitator and inflated for use.

Bladder 12 for proper function is placed under the agitator in a washer tub in its deflated form. The split design and flat construction allow for easy installation as the split will open and surround the existing drive shaft of said washing machine. This is illustrated in FIG. 5 with the bladder partially inflated with liquid. Introduction of water from the cold water supply, usually available at between 40 to 80 p.s.i., will fill the bladder at a slow rate. This pressure is spread over the bottom surface of the agitator to provide sufficient force to remove the stuck agitator. FIGS. 4–17 illustrates this operation showing how the outer doubler prevents ballooning in an outward direction from the center of the agitator.

While my novel washing machine agitator removing means has been herein described and illustrated in what I consider to be a preferred embodiment, it will be appreciated by those skilled in the art that the present invention is not limited to that particular embodiment, but includes within its scope all variant forms thereof encompassed by the language of the following claims. One such variant, for example, could include a bladder sized and shaped generally like bladder 12 but formed as a single integral part with a portion corresponding to the zone 17 portion of the latter having a wall thickness of 0.080 inch and the remainder having a wall thickness of 0.040 inch. Such a bladder would be similar to FIGS. 3–12 and 20 in dimensions and wall thickness variations.

The bladders of this invention can be formed without difficulty from rubber, latex or any other suitably resilient material by those familiar with rubber processing techniques in the light of the present teachings. Where the bladder is assembled from two separately formed parts, as is bladder 12, the first being a core bladder of uniform thickness throughout and the second a doubler 17 sized to circumferentially embrace the outer portion of the first part. The first part (core bladder) is formed from liquid latex or the like around a properly sized and shaped mold, then slit at one end, and blown off the mold with pressurized air. The slit is next sealed and the doubler fitted around the resulting bladder. As indicated above, a suitable rubber cement or the like is employed to secure the doubler in place on the bladder.

I claim:

1. A jack device adapted to quickly and easily break an agitator in an automatic washing machine loose from a shaft to which it has become stuck by scale deposits, said device comprising: a bladder of toroidal form and split-ring configuration when deflated, the deflated bladder being of a size to fit substantially entirely underneath said agitator in said washing machine around said shaft, said bladder having a radially outwardly disposed portion of its wall approximately double the thickness of the remaining portion thereof, said thicker portion extending inwardly from the periphery approximately one third of the diameter of said bladder, to prevent outward ballooning of the bladder from the space underneath said agitator when the bladder is inflated, whereby inflation of the bladder, so positioned causes it to expand upwardly into contact with the bottom of the agitator to thereby free the agitator from its attachment to said shaft; a flexible tube and means attaching it to said bladder in a way to permit inflation of said bladder therethrough by hydraulic or pneumatic pressure.

2. Bladder means in accordance with claim 1 in which said bladder has an outside diameter of approximately 11 inches and encircles a central opening of about 4 inches when deflated.

* * * * *